US005820336A

United States Patent [19]

Hashimoto

[11] Patent Number: 5,820,336

[45] Date of Patent: Oct. 13, 1998

[54] GAS TURBINE STATIONARY BLADE UNIT

[75] Inventor: Yukihiro Hashimoto, Takasago, Japan

[73] Assignee: Mitsubishi Heavy Industries, Ltd., Tokyo, Japan

[21] Appl. No.: 861,518

[22] Filed: May 22, 1997

[51] Int. Cl.[6] ..... F04D 29/38

[52] U.S. Cl. ..... 415/115; 416/95

[58] Field of Search ..... 415/115, 116; 416/95, 96 A, 96 R

[56] References Cited

U.S. PATENT DOCUMENTS

| | | | |
|---|---|---|---|
| 3,240,468 | 3/1966 | Watts et al. | 415/115 |
| 4,118,146 | 10/1978 | Dierberger | 415/115 |
| 4,835,958 | 6/1989 | Rice | 415/114 |
| 5,531,568 | 7/1996 | Broadhead | 415/115 |
| 5,634,766 | 6/1997 | Cunha et al. | 415/115 |

*Primary Examiner*—John T. Kwon
*Attorney, Agent, or Firm*—Wenderoth, Lind & Ponack, L.L.P.

[57] ABSTRACT

Because a gas turbine stationary blade is exposed to a high speed, high temperature gas flow, its service life is shortened due to thermal stress and high temperatures. The present invention provides a gas turbine stationary blade unit with reduced thermal stress, a high cooling effect and an elongated service life. A blade (103) is formed by a thin plate panel (110) formed with a reinforcing element (105) disposed on an inner side or cooling side of the blade (103). Thereby, thermal stress occurring at the blade (103) is reduced as well as the fluid force acting on the blade (103) by an operating gas (G) is transmitted to a stationary blade holding portion (104) via the reinforcing element (105). Thus, the thickness or rigidity of a connection portion of the blade (103) and an outer shroud (101) need not be increased, and a thermal deformation and an unhomogenous distribution of thermal stress can be avoided. Further, in addition to the thinning of the blade, an overall cooling effect is enhanced by cooling the reinforcing element (105), thereby preventing high temperatures and extending the service life of the turbine stationary blade.

5 Claims, 4 Drawing Sheets

GAS TURBINE STATIONARY BLADE UNIT

BACKGROUND OF THE INVENTION

1. Field of the Invention

The present invention relates to a gas turbine stationary blade unit, provided on an upstream side of a movable gas turbine blade, for governing the speed of an operating gas flowing to the gas turbine moving blade, and more specifically to a gas turbine stationary blade unit which is effective in extending the thermal fatigue life thereof.

2. Description of the Prior Art

A gas turbine stationary blade is a component having a function of governing gas flow speed and receives a fluid force created by high speed flow of a high temperature operating gas. Accordingly, strength and the useful life of the gas turbine stationary blade requires and is dependent on, creep resistance, thermal fatigue resistance, high temperature, high cycle fatigue resistance and oxidation resistance. As for a gas turbine, there is a current attempt to realize a higher temperature along with a movement for high efficiency and, accompanying therewith, cooling of the gas turbine stationary blade is also being strengthened. Furthermore, as to the operation of the gas turbine, there are increasing cases of operation under severe conditions involving a high frequency of starting and stopping, such as DSS (daily start stop) operation etc.

Thus, accompanying with realization of a high temperature gas turbine and a cooling strengthening of the gas turbine stationary blade, a thermal load of the gas turbine stationary blade becomes high and thermal stress becomes high and yet, due to an increase in the frequency of start and stop, etc., there is occurring a problem of a low cycle fatigue life of the gas turbine stationary blade. Also, a reduction of thermal stress is becoming a key point for elongation of the fatigue life.

A prior art construction for reducing thermal stress in a gas turbine stationary blade is shown in FIG. 4 and is disclosed by the Japanese laid-open utility model application No. Sho 57(1982)152404, the Japanese laid-open utility model application No. Sho 61(1986)-166104 and the Japanese laid-open utility model application No. Hei 3(1991)-37206, etc. In this construction, a blade 401, an outer shroud 402 of an outer peripheral side of the blade 401 and an inner shroud 403 of an inner peripheral side of the blade 401 compose a gas turbine stationary blade unit in which the blade 401 and the outer shroud 402 are connected and the blade 401 and the inner shroud 403 are connected, respectively, via a blade fitting jig 404 and there is provided a gap portion 405 between the blade 401 and the inner shroud 403, respectively, so that a deformation restriction between the respective two portions may be lessened.

There is also a prior art construction shown in FIG. 5 that is disclosed by the Japanese laid-open utility model application No. Sho 59(1984)-141102 etc. In this construction, a heat insulating plate 501 is provided in the vicinity of connection portions 508 of a blade 401 and an outer shroud 402 and of the blade 401 and an inner shroud 401 so that a gas path is formed between the heat insulating plate 501 and the outer shroud 402 and between the heat insulating plate 501 and the inner shroud 403, respectively. Also, a heat insulating coating 502 is applied to the respective surface, which forms one surface of the gas path, of the outer shroud 402 and of the inner shroud 403. Thus, a thermal load at each connection portion 508, where a specifically large thermal stress occurs, is alleviated and a temperature difference due to the thermal load at each connection portion 508 is made smaller.

However, in the fitting structure of the blade 401 and the outer shroud 402 or the inner shroud 403 of the prior art gas turbine stationary blade unit shown in FIG. 4 and in a fitting structure of the heat insulating plate 501 fitted to the vicinity of the connection portion 508 of the blade 401 and the outer shroud 402 or the inner shroud 403 of the prior art gas turbine stationary blade unit shown in FIG. 5, there is a requirement to provide a function, such as a resistant force etc., against a seal of operating gas, an exciting force due to operating gas and a bending force due to operating gas. Hence, the structure of the portions becomes complicated and there has been a difficulty in putting it into practical use.

Also, in applying the heat insulating coating 502 to the outer shroud 402 and the inner shroud 403 of the gas turbine stationary blade unit shown in FIG. 5, there are problems of peeling etc. due to a temperature difference between a base material of the outer shroud 402 or the inner shroud 403 and a heat insulating coating material, which results in a lack of reliability.

For this reason, in order to alleviate the deformation restriction and reduce the temperature difference at the connection portions 508 of the blade 401 and the outer shroud 402 and of the blade 401 and the inner shroud 403, there is disclosed a construction of a gas turbine stationary blade unit, as shown in FIG. 6, for reducing a thermal load at the connection portions 508 by using a structure of a thin plate having a thickness which may withstand only a fluid force of operating gas, together with film cooling holes 601, a heat insulating coating 502 as described in FIG. 5, etc.

While such use of the thin plate in the gas turbine stationary blade unit is effective for reducing a thermal stress, however, it has certain limitations with respect to resistance against an exciting force and a bending force due to the fluid force of the operating gas. Especially, as the blade 401 and the connection portion 508 of the blade 401 and the outer shroud 402 which transmits the fluid force of operating gas G, received by the blade 401, to a stationary blade holding portion 603 make contact with the high temperature operating gas G, even if a cooling medium supplied inbetween a cooling passage bulkhead 602 provided within the blade 401 is jetted through the film cooling holes 601 for a film cooling, there is difficulty in attaining sufficient thinning of the structure.

At the connection portion 508 of the blade 401 and the outer shroud 402 and at the outer shroud 402 itself, a sufficient thinning of structure is difficult for reason of the above-described limitation, and as a result, due to a difference of thermal capacity between the blade 401 and the outer shroud 402 and due to a size of reaction force against a thermal deformation of the outer shroud 402, etc., a sufficient reduction of thermal stress is not attained well in the gas turbine stationary blade so that it is a present situation that a life elongation of the gas turbine stationary blade is not attained yet.

SUMMARY OF THE INVENTION

In order to solve the above-mentioned problems in the prior art, it is an object of the present invention to provide a gas turbine stationary blade unit in which a blade is made thinner to the extent possible so that a thermal stress is reduced and a reinforcing element for reinforcing such thinned blade is disposed on a cooling side of the blade. Thereby sufficient rigidity can be maintained for resisting a fluid force of the operating gas, and cooling is achieved for preventing high temperatures and thus thermal fatigue can be prevented resulting in an extended service life of the blade.

In order to attain the above object, the present invention provides a gas turbine stationary blade unit which comprises a blade, an outer shroud fixed to an outer peripheral side or end of the blade, and an inner shroud fixed to an inner peripheral side or end of the blade. The blade is supported by a stationary blade holding portion provided on an upstream side of a gas turbine moving blade. The stationary blade unit governs the speed of a high temperature gas fluid flowing to the gas turbine moving blade. The blade is formed by a thin plate panel and a reinforcing element for reinforcing the thin plate panel from a side of a cooling passage formed within the thin plate panel.

In a high temperature structural body, cooling becomes necessary, and in this case thermal stress caused by a temperature difference in the structural body is effectively reduced by making the structural body thinner. However, in a structural body, such as a blade, which must withstand a force acting from outside, like a fluid force created by the flow of operating gas, the extent of thinning of the blade structure is limited. Accordingly, the gas turbine stationary blade unit according to the present invention, constructed as mentioned above, employs a fluid force resisting structure comprising a reinforcing element which is applied to the thin plate panel. The reinforcing element is disposed on an interior cooling side of the thin plate panel where a cooling passage for the flow of a cooling medium is provided so that temperature elevation of the reinforcing element is suppressed while rigidity of the blade structure is maintained. Thus, by the effect of a thinned structural body and cooling of the reinforcing element, a cooling, strengthening, and thermal stress reduction become attainable, thereby maintaining a function of the gas turbine stationary blade and effecting a service life elongation.

Also, in the gas turbine stationary blade unit according to the present invention, the thin plate panel and the reinforcing element are formed integrally by casting. Thereby, work required to attach the thin plate panel and the reinforcing element within the thin plate panel becomes unnecessary, so that formation of blade is facilitated. The joined portion of the thin plate panel and the reinforcing element becomes higher in strength which is homogenized along the entirety of the blade and a peeling of the reinforcing element from the thin plate panel can be prevented securely.

Also, in the gas turbine stationary blade unit according to the present invention, the reinforcing element is disposed in a plurality of lengthwise and widthwise rows on an interior surface of the thin plate panel. Thereby, the fluid force of the operating gas, which acts on the entire surface of the blade, can be transmitted to the outer shroud side so as to be resisted by the reinforcing element. Also, the bending strength of the thin plate panel can be enhanced, thereby allowing the plate panel to be thinned sufficiently and the thermal stress to be reduced.

Also, in the gas turbine stationary blade unit according to the present invention, each upper end portion of the reinforcing element disposed in a plurality of rows lengthwise on the thin plate panel is connected to the stationary blade holding portion via a fluid force absorption shroud reinforcing element, which is integrated with a cooling passage bulkhead forming the cooling passage, for reinforcing the outer shroud. Thereby, the entire fluid force of the operating gas acting on the blade can be transmitted to the stationary blade holding portion without being concentrated on connection portions of the blade and the outer shroud. Thus, the rigidity of the connection portion can be reduced, so that the thin plate panel can be thinned sufficiently and thinning of the outer shroud also becomes possible.

Also, in the gas turbine stationary blade unit according to the present invention, an impingement plate in which impingement holes are provided for cooling the reinforcing element by a cooling medium flowing in the cooling passage is disposed between the reinforcing element and the cooling passage walls. Thereby, the reinforcing element is cooled sufficiently so that lowering of the rigidity can be alleviated. Also, due to the cooling fin effect provided by the reinforcing element, the cooling of the thin plate panel, the outer shroud and the inner shroud is improved. Thus, the thermal fatigue life of the gas turbine stationary blade can be extended.

DESCRIPTION OF THE PREFERRED EMBODIMENTS

Herebelow, description is made of preferred embodiments of a gas turbine stationary blade unit according to the present invention with reference to figures.

Figure 1:
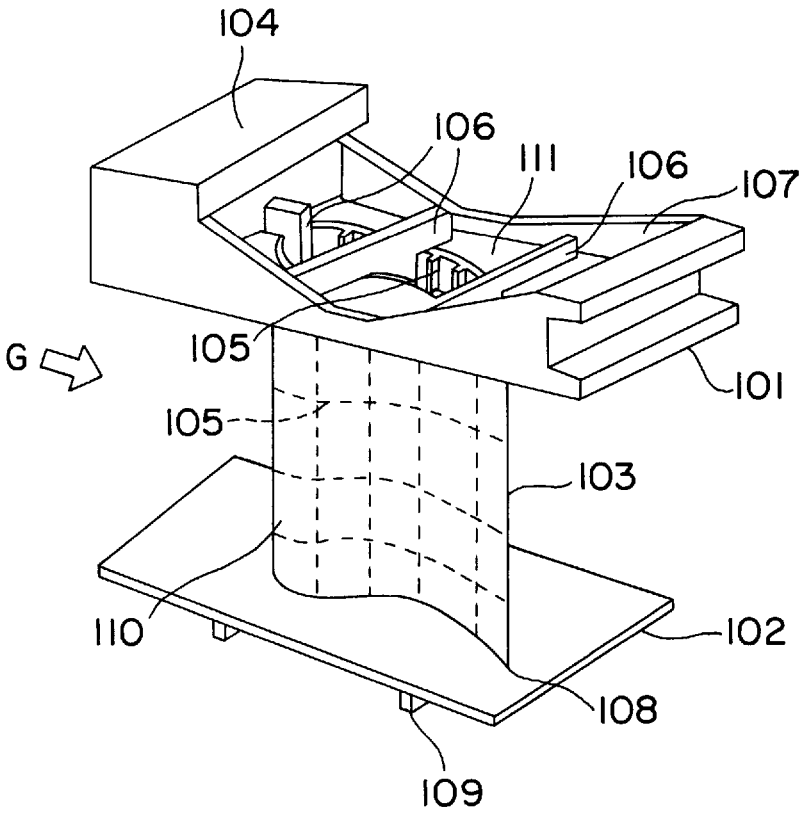
FIG. 1 is an overall perspective view of one preferred embodiment of a gas turbine stationary blade unit according to the present invention.

FIG. 1 shows an overall perspective view of one preferred embodiment of a gas turbine stationary blade unit according to the present invention. In this preferred embodiment, the stationary blade unit is supported by a stationary blade holding portion 104 fixed to a housing (not shown). That is, there is a cantilever structure by which a fluid force of an operating gas G received by a blade 103 is transmitted to the stationary blade holding portion 104 via a connection portion 108 of an outer shroud 101 and the blade 103. Incidentally, the connection portion 108 is not shown in the figure but is formed between the outer shroud 101 and the blade 103. Likewise a connection portion 108 is formed between an inner shroud 102 and the blade 103.

Figure 2:
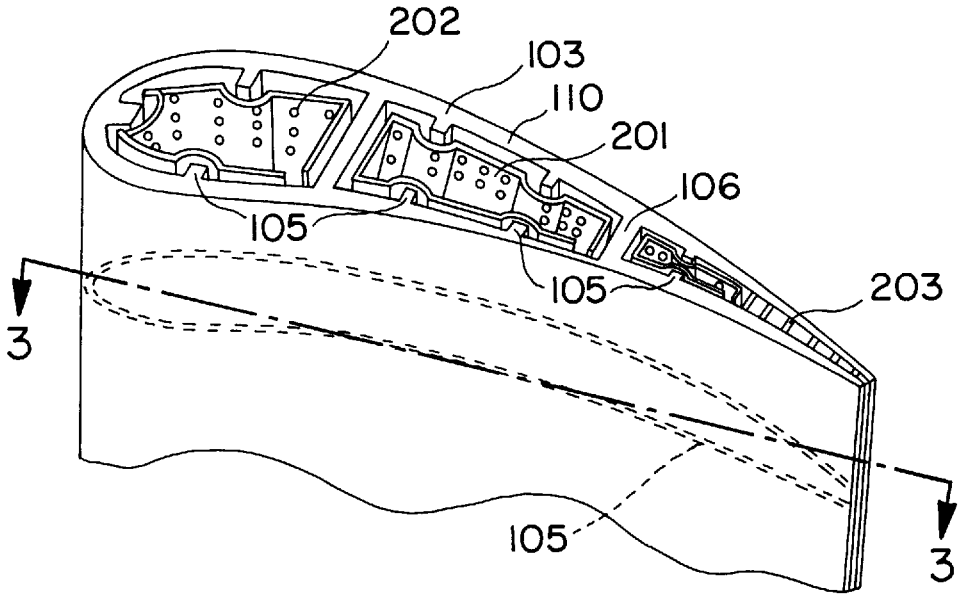
FIG. 2 is a partially cut out perspective view of a blade of the preferred embodiment shown in FIG. 1.
Figure 3:
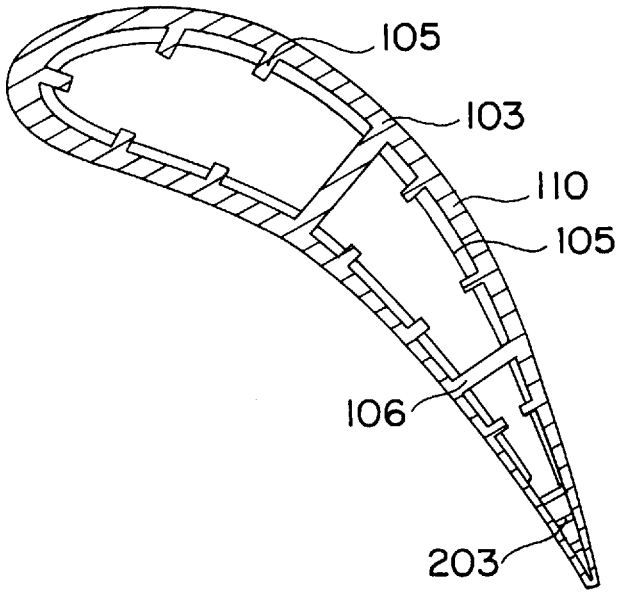
FIG. 3 is a cross sectional view taken along line A—A in the direction of arrows in FIG. 2.
Figure 4:
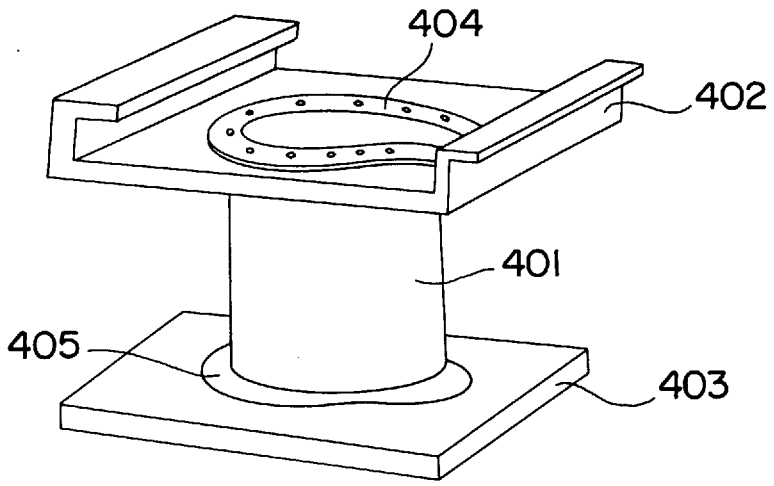
FIG. 4 (PRIOR ART)
FIG. 4 is a perspective view showing one example of a prior art gas turbine stationary blade unit.
Figure 5:
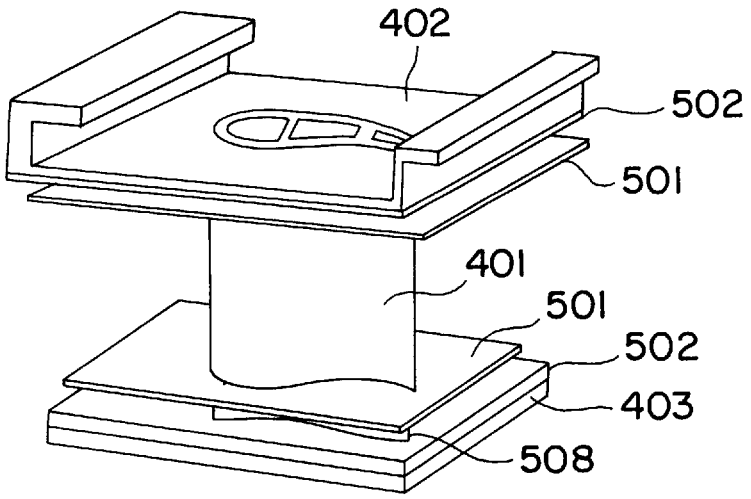
FIG. 5 (PRIOR ART)
FIG. 5 is a perspective view showing another example of a prior art gas turbine stationary blade unit.
Figure 6:
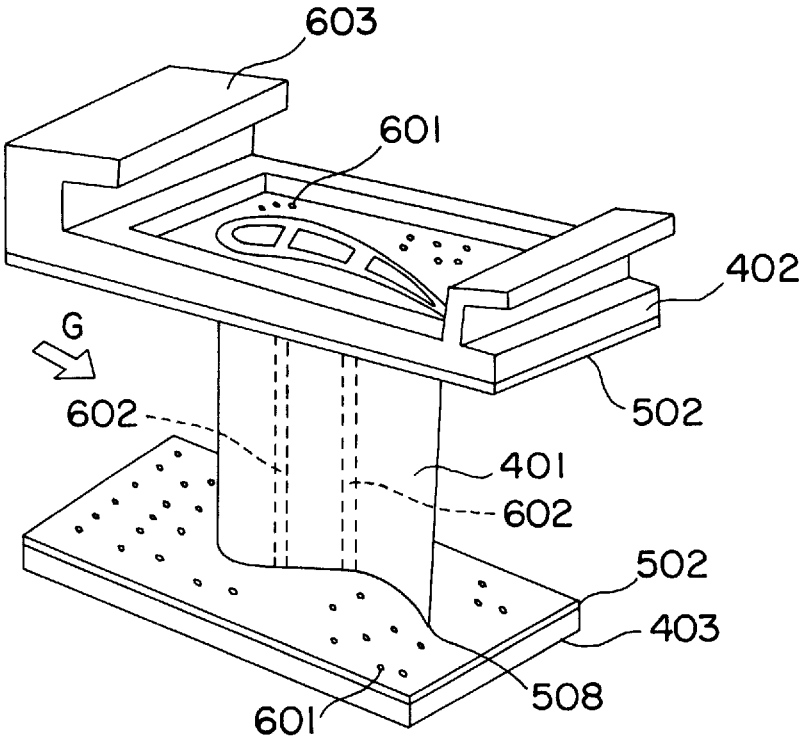
FIG. 6 (PRIOR ART)
FIG. 6 is a perspective view showing still another example of a prior art gas turbine stationary blade unit.

As indicated above, FIG. 2 is a partially cut out perspective view of the blade 103 and FIG. 3 is a cross sectional view taken on line A—A in the direction of the arrows in FIG. 2. In order to attain a reduction of thermal stress of the blade 103, the blade 103 itself is formed by a thin plate panel 110 which is reduced in thickness as compared with a conventional blade. In this construction, in order for the thin plate panel 110, forming a profile of the blade 103, to resist the fluid force of the operating gas G, lengthwise and widthwise reinforcing portions forming reinforcing element 105 are provided, as shown in dotted lines in FIG. 1. The reinforcing element 105 is disposed on a cooling side of the thin plate panel 110, that is, on an inner surface side of the blade 103 which is opposite to an outer surface side which directly contacts the operating gas G. Thus, bending strength of the thin plate panel 110 is enhanced.

The reinforcing element 105 is formed integrally with the thin plate panel 110 by casting, and is not fixed to the thin plate panel 110 by welding etc. That is, the reinforcing element 105 provided on the inner surface side of the thin plate panel 110 is integrally formed with the blade by casting by use of a core made by $SiO_2$ for forming a shape having a multitude of the reinforcing portions arranged lengthwise and widthwise of the thin plate panel 110. Likewise a manufacture of a turbulence promotor provided in a cooling passage within a prior art blade for the purpose of promoting cooling by a cooling medium flowing within the blade can be formed, and thereafter the core is melted by NaOH in an autoclave.

As the blade 103 itself is so formed, fluid force of the operating gas G, distributed so as to act on the entire surface of the blade 103, is transmitted to the outer shroud 101 by the reinforcing element 105. In order to avoid loading the connection portion 108 of the blade 103 and the outer shroud 101, the fluid force transmitted to the outer shroud 101 is transmitted to the stationary blade holding portion 104 via a shroud reinforcing element 107 and a fluid force absorption shroud reinforcing element 106 which is integrated with a cooling passage bulkhead of the blade 103. Both reinforcing elements 106, 107 are for reinforcing a thin plate panel 111 formed on an upper surface of the outer shroud 101. Thereby, the outer shroud 101, on the inner periphery of which the fluid force due to the operating gas acts, can be sufficiently thinned.

Like the outer shroud 101, the inner shroud 102 also receives the fluid force on its outer peripheral surface. Hence, an inner shroud reinforcing element 109 is applied to an inner peripheral surface of the inner shroud.

The reinforcing portions of the reinforcing element 105 of the blade 103 are formed by use of the core, as mentioned above, so as to be disposed lengthwise and widthwise on an inner surface of the blade 103. Also, by use of an impingement plate 201 having impingement holes 202 and disposed within the blade 103, a cooling medium supplied inbetween the cooling passage bulkhead 106 is jetted and the reinforcing element 105 itself is cooled. Thereby, a cooling fin effect can be obtained and cooling and strengthening of the gas turbine stationary blade can be attained. Also, a homogenization of a temperature distribution along the entire gas turbine stationary blade, as well as a reduction of a thermal stress, can be attained.

Incidentally, numeral 203 in FIGS. 2 and 3 designates a pin fin provided for enhancement of a cooling effect of a rear edge side of the blade 103.

Such a thin plate reinforcing structure, employed for the gas turbine stationary blade according to the preferred embodiment in which the thin plate panel 110 is reinforced by the reinforcing element 105 etc., is often used as a weight reducing and cost reducing structure in machinery or equipment which is a large structural body and requires a pressure resisting ability, such as a duct, a boiler, etc.

In this preferred embodiment, the reinforcing portions of the reinforcing element 105 is disposed lengthwise and widthwise on the cooling passage (cooling medium passage) side of the blade 103 and the cooling medium flowing through the cooling passage is accelerated so as to be turbulated with an effect of cooling strengthening. Thus, not only can a thermal stress reduction by use of the thin plate panel 110 be attained, but also service life elongation and a cooling ability enhancement of the gas turbine blade can be attained.

As for pressure resistance, the reinforcing element 105 is fitted to the thin plate panel 110, thereby an effective width to bear a pressure around the reinforcing element 105 is obtained and a bending strength of the thin plate panel 110 can be increased, which becomes an effective means for preventing buckling due to the fluid force of the operating gas G or a creep buckling, etc.

Further, the fluid force absorption shroud reinforcing element 106 is disposed at the connection portion 108 of the blade 103 and the outer shroud 101, and thus the fluid force to be transmitted finally to the stationary blade holding portion 104 from the reinforcing element 105, which have a large rigidity difference, via the outer shroud 101 is partially transmitted from the reinforcing element 105 to the stationary blade holding portion 104 via the fluid force absorption shroud reinforcing element 106. Thus, a thermal stress occurring at the connection portion 108 of the blade 103 and the outer shroud 101 or at the outer shroud 101 itself can be reduced and, as a result, thinning of these portions can be realized.

As for cooling, by use of the thin plate panel 110, metal temperature on the side of the operating gas G is reduced as compared with an average metal temperature which is determined by the cooling efficiency. Also, by cooling of the reinforcing element 105, disposed on the cooling side, the reinforcing element 105 function as cooling fins so as to enhance the cooling effect. Thus, a reduction of the amount of cooling air used as a cooling medium can be attained, so that enhancement of the entire gas turbine efficiency can be realized. Further, the reinforcing portions of the reinforcing element 105 are disposed lengthwise and widthwise along a profile of the interior of the blade 103. Therefore, a homogenization of cooling of the blade 103, and thus a homogenization of temperature distribution, can be attained, which contributes to a large reduction of thermal stress.

According to the gas turbine stationary blade unit of the present invention, by use of a construction as mentioned in the appended claims, the blade thickness is reduced sufficiently, the thermal stress is adequately reduced and the reinforcing element of the thinned blade is cooled sufficiently. Thus, a blade structure in which cooling is improved can be obtained.

Furthermore, service life is extended due to thermal fatigue reduction, prevention of high temperature oxidation, rigidity against the exciting force and resisting force against the fluid force can be attained, and yet reduction of the cooling air amount, large improvement in the life of the gas turbine stationary blade and enhancement of the entire gas turbine efficiency can be expected.

While the preferred form of the present invention has been described, variations thereto will occur to those skilled in the art within the scope of the present inventive concepts which are delineated by the following claims.

I claim:

1. A gas turbine stationary blade unit for governing the speed of a high temperature gas flowing to a movable gas turbine blade, said gas turbine stationary blade unit comprising:

a blade including a thin plate panel having an interior peripheral surface defining an interior blade cooling passage, a blade reinforcing element formed on said interior peripheral surface of said thin plate panel, a longitudinal cooling passage bulkhead extending longitudinally through said thin plate panel, and at least one fluid force absorbing element formed integrally with said longitudinal cooling passage bulkhead;

an inner shroud fixed to an inner peripheral portion of said blade;

an outer shroud fixed to an outer peripheral portion of said blade;

a stationary blade holding portion fixed to said outer shroud at an upstream side of said outer shroud;

wherein said fluid force absorbing element projects outwardly of said outer shroud and extends across opposing sides of said thin plate panel such that said fluid force absorbing element reinforces said outer shroud, absorbs fluid forces acting on said thin plate panel, and transmits the fluid forces to said outer shroud.

2. The gas turbine stationary blade unit as claimed in claim 1, wherein said thin plate panel, said blade reinforcing element, and said fluid force absorbing element are formed integrally by casting.

3. The gas turbine stationary blade unit as claimed in claim 1, wherein:

said blade reinforcing element comprises reinforcing portions which are arranged in a plurality rows extending along a length of said thin plate panel and a plurality of rows extending along a width of said thin plate panel, and said at least one fluid force absorbing element comprises a plurality of fluid force absorbing elements disposed in a plurality of rows and extending across the opposing sides of said thin plate panel.

4. The gas turbine stationary blade unit as claimed in claim 3, further comprising a shroud reinforcing element projecting outwardly from said outer shroud and connected to a portion of said fluid force absorption element, wherein each upper end portion of said reinforcing portions of said blade reinforcing element, which are arranged in a plurality rows extending along the length of said thin plate panel, is connected to said stationary blade holding portion via said fluid force absorption element.

5. The gas turbine stationary blade unit as claimed in claim 3, further comprising an impingement plate disposed within said thin plate panel, said impingement plate having a plurality of impingement holes for cooling said blade reinforcing element by a cooling medium flowing in said cooling passage.

* * * * *